US006054079A

United States Patent [19]

Toet et al.

[11] Patent Number: 6,054,079

[45] Date of Patent: Apr. 25, 2000

[54] METHOD AND INSTALLATION FOR COMPACTING A GRANULAR MASS, SUCH AS CONCRETE MORTAR

[75] Inventors: Gijsbert Toet, Eksel, Belgium; Anne-Huig Den Boer, Streefkerk, Netherlands

[73] Assignee: Den Boer Staal B. V., Groot-Ammers, Netherlands

[21] Appl. No.: 09/057,460

[22] Filed: Apr. 9, 1998

[30] Foreign Application Priority Data

| | | | |
|---|---|---|---|
| Apr. 9, 1997 | [NL] | Netherlands | 1005779 |
| Apr. 21, 1997 | [NL] | Netherlands | 1005862 |

[51] Int. Cl.[7] ..... B28B 1/087; B28B 3/02; B30B 11/04

[52] U.S. Cl. ..... 264/71; 264/72; 425/421; 425/432; 425/456

[58] Field of Search ..... 425/421, 432, 425/456; 264/69, 71, 72

[56] References Cited

U.S. PATENT DOCUMENTS

| | | | |
|---|---|---|---|
| 1,937,028 | 11/1933 | Lux et al. | 264/72 |
| 3,767,351 | 10/1973 | Blaser . | |
| 4,456,574 | 6/1984 | Frey et al. | 264/71 |
| 4,725,220 | 2/1988 | Percinel et al. | 264/72 |
| 4,778,278 | 10/1988 | Vanvoren et al. | 425/456 |
| 5,606,231 | 2/1997 | Kroger et al. | 425/421 |
| 5,863,476 | 1/1999 | Wier | 264/72 |

FOREIGN PATENT DOCUMENTS

| | | | |
|---|---|---|---|
| 1 267 584 | 5/1968 | Germany . | |
| 38 37 686 | 5/1990 | Germany | 425/456 |
| 44 34 696 | 3/1995 | Germany . | |
| 591 410 | 8/1947 | United Kingdom . | |

OTHER PUBLICATIONS

H. Kuch, "Verfahrenstechnische probleme bei der formgebung und verdichtung kleinformatiger betonerzeugnisse", pp. 80–87, Betonwerk + BFT Fertigteil–Technik, vol. 58, No. 4, Apr. 1992.

*Primary Examiner*—Mathieu D. Vargot
*Attorney, Agent, or Firm*—Young & Thompson

[57] ABSTRACT

In a method for compacting a granular, loosely coherent mass, such as moist mortar, to obtain end products such as paving stones, kerbstones and the like, an installation is used which includes a vibrating table, a mold for the mass to be compacted, a stamp for pressing the mass into the mold, a hydraulic exciter and a hydraulic pressure element respectively connected to the vibrating table and the stamp, and a driver and a controller for controlling the exciter and pressure elements. The method includes the steps of selecting a frequency range with a lower value and an upper value for the excitation frequency, and controlling the excitation frequency so that it passes through at least part of the frequency range and so that it reaches the natural frequency of the hydraulic-mechanical mass spring system formed by the movable part of the exciter, the vibrating table, the mold and the mass to be compacted, as well as the compressible hydraulic medium present between the movable part of the exciter and the driver concerned.

10 Claims, 2 Drawing Sheets

METHOD AND INSTALLATION FOR COMPACTING A GRANULAR MASS, SUCH AS CONCRETE MORTAR

BACKGROUND OF THE INVENTION

The invention relates to the field of compaction of a granular, loosely coherent mass, such as moist concrete mortar. Compaction of the mass results in a reduction in the air content and the production of a firm coherent product, The products concerned can be paving stones, kerbstones and a wide variety of other products made of concrete and the like.

NL-A 8004995 discloses a method for compacting concrete in which the starting material is brought into sine-wave vibration and at the same time is placed under pressure, The vibration frequency and the degree of pressure can be adjusted to the characteristics of the starting material. The installation used for this known method can be driven by electro-hydraulic means.

Although better results, that is to say lower noise production and a well-compacted end product having the desired mechanical properties, can already be obtained with this known method and installation than can be obtained with the conventional installation operating with purely electro-mechanical means, it is nevertheless found that there is still room for improvement.

SUMMARY OF THE INVENTION

The aim of the invention is to provide an improved method and installation for compacting, for example, moist concrete mortar. Said aim is achieved by a method for the operation of a compacting installation for compacting a granular, loosely coherent mass, such as moist mortar, in order to obtain end products such as paving stones, kerbstones and the like, which installation comprises a vibrating table as well as a mould for the mass to be compacted, a stamp for pressing the mass into the mould, a hydraulic exciter and a hydraulic pressure element connected to vibrating table or stamp, drive means plus control means for controlling exciter and pressure element, which method comprises the following steps:

- selection of a frequency range with a lower value and an upper value for the excitation frequency,
- control of the excitation frequency such that it passes through at least part of said frequency range and that the natural frequency of the hydraulic-mechanical mass spring system formed by the movable part of the exciter, the vibrating table, the mould and the mass to be compacted, as well as the compressible hydraulic medium present between the movable part of the exciter and the drive means concerned (such as an electro-hydraulic control element), is reached.

The pressure to which the material to be treated is subjected also plays a role in this process. In order to obtain the desired results, the pressure in the hydraulic pressure element is therefore preferably changed continually, specifically as a function of the progress of the compaction process which takes place under the influence of the excitation frequency supplied by the exciter.

The pressure in the hydraulic pressure element can be controlled in accordance with a pressure/time function and the frequency of the hydraulic exciter in accordance witl a frequency/time function, which functions can be linked.

The compaction, and thus the mechanical quality, of the end product are greater the higher the accelerations produced during vibration. These vibrations have a straight line relationship with the amplitude of the sine-wave vibration, but increase quadratically with the frequency thereof. For this reason the method according to the invention yields products with outstanding mechanical properties.

A further advantage with the method according to the invention is that the compaction time can be relatively short. Such a short production time is favourable for the total production of the installation.

These advantages result from the fact that the granular mass is not exposed to only one specific frequency. According to the invention, the mass is exposed to a number of different frequencies on passing through the frequency range. Consequently a mass containing varying grain sizes is also able to achieve good compaction within a relatively short time.

Using the method according to the invention, quantities of material with diverse masses can be compacted in the desired manner. In order to achieve the desired compaction result even under these varying conditions, the volume of the compressible hydraulic medium can be varied.

The invention also relates to an installation for carrying out the abovementioned method, comprising a vibrating table as well as a mould for the mass to be compacted, a stamp for pressing the mass into the mould, a hydraulic exciter and a hydraulic pressure element connected to vibrating table or stamp, drive means plus control means for controlling the hydraulic pressure in the pressure element, as well as control means for controlling the dynamic hydraulic volume flow (frequency) in the exciter. An installation of this type is disclosed in EP-A 620 090. In order to obtain the compaction process described above, the vibrating table and the mould can be fixed to one another such that they can be brought into vibration as a whole by the exciter.

Because the vibrating table and the mould function as a whole during vibration, uniform treatment of the total volume of starting material is ensured. The product obtained consequently therefore also has uniform characteristics.

Preferably, the mould is open on its underside and is positioned on a plate which closes off the mould on said underside and which can be fixed together with the mould on the vibrating table. After compaction, the mould is removed, after which the product remains behind on the plate and can thus be further transported.

To obtain the desired mutual connection, the vibrating table has clamping jaws which can be brought into interaction with the mould for clamping the latter on the vibrating table. To this end, the mould can have clamping surfaces which face away from the vibrating table, on to which clamping surfaces the clamping jaws are able to engage. It is important that the clamping force exerted by the clamping jaws is variable.

BRIEF DESCRIPTION OF THE DRAWINGS

The invention will be explained in more detail below with reference to the figures.

DESCRIPTION OF THE PREFERRED EMBODIMENTS

Figure 1:
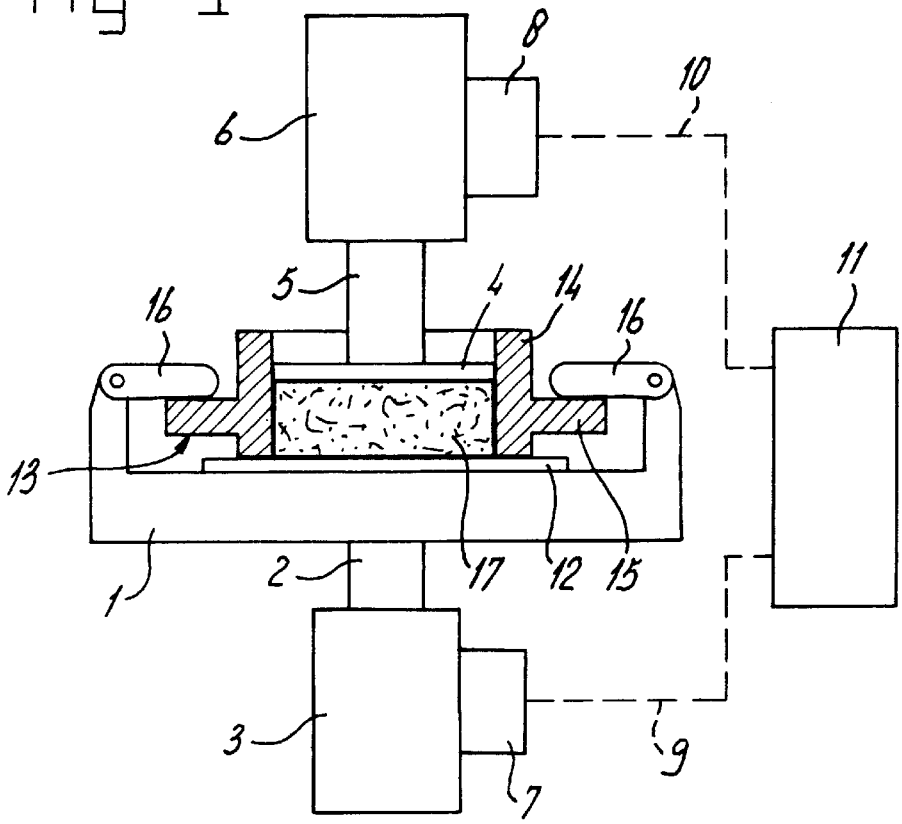
FIG. 1 shows a diagrammatic view of an installation for carying out the method according to the invention.

The installation shown in FIG. 1 comprises a vibrating table 1, which is connected to the piston rod 2 of the hydraulic exciter 3.

The installation further comprises a stamp 4, connected to the piston rod 5 of the hydraulic cylinder 5, 6. Both the exciter 3 and the hydraulic cylinder 5, 6 are controllable by servomechanisms 7, 8, which are connected via electrical control leads 9, 10 to an electronic control device 11.

A transport plate 12 is laid on the vibrating table 1, onto which transport plate the mould, which is indicated in its entirety by 13, is placed. Said mould is open top and bottom and essentially consists of an enclosing wall 14 of the desired cross-sectional shape of the product, plus a flange 15.

The clamping jaws 16 of a clamping mechanism can be clamped on said flange 15 with an adjustable, optionally programmable clamping force. A number of clamping jaws 16 are fitted around the periphery of the flange 15 such that, from the mechanical standpoint, mould 13, plate 12 and vibrating table 1 function as one entity, also in respect of the vibrations generated in the vibrating device.

The material to be treated, such as concrete mortar (mortar), 17 is placed in the mould and is then brought into vibration by the exciter 3, vibrating table 1, plate 12 and mould 13.

The stamp 4 has a shape which is matched to the interior shape of the mould 13 and on vibration exerts a prescribed pressure on the mortar 17.

The level of this pressure can be adjusted by the control unit 11 to a value which is optimum for compaction of a specific type of mortar. During compaction said pressure is able to change continually as a function of time in order to allow the compaction process to proceed in an optimum manner.

It is also important that the pressure/time function of the hydraulic cylinder 5, 6 can be coupled to the frequency/time function with which the exciter 3 is operated.

In this context it is important that the acceleration generated by sine-wave excitation is dependent on the relationship: $a=s(2\pi f)^2$, In this equation, f is the frequency and s the amplitude of the vibrations, It can be seen from this equation that the acceleration a has a straight line relationship with s but increases quadratically with increasing frequency.

The compaction of the mortar which is obtained is highly dependent on the magnitude of the acceleration to which this is subjected. The point is therefore not only to generate as large as possible an amplitude but also to generate the highest possible frequency within the frequency range.

Figure 2:
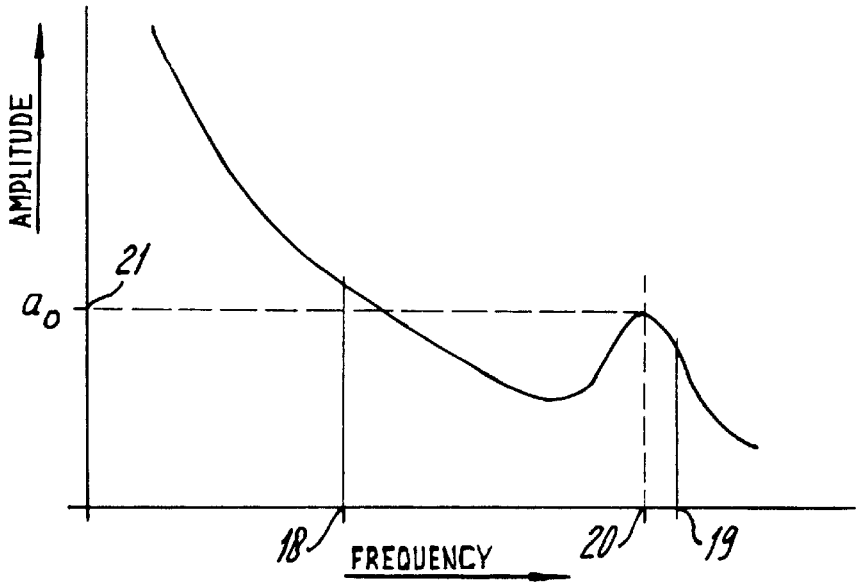
FIG. 2 shows a graph showing the characteristics of the compaction process according to the invention.

With regard to the magnitude of the amplitude produced, and thus with regard to the accelerations, considerable benefit can be obtained here by means of the hydraulic-mechanical mass spring system as shown in FIG. 1, as will be explained with reference to FIGS. 2 and 3.

The mass of said mass spring system is formed by the piston 2 of the exciter, the vibrating table 1, the plate 12 and the mould 13 together with mortar 17.

The system spring is formed by the compressible medium (such as oil) between the electro-hydraulic control element 7 and the surface of the piston rod 2 which is in contact with said medium.

Figure 3:
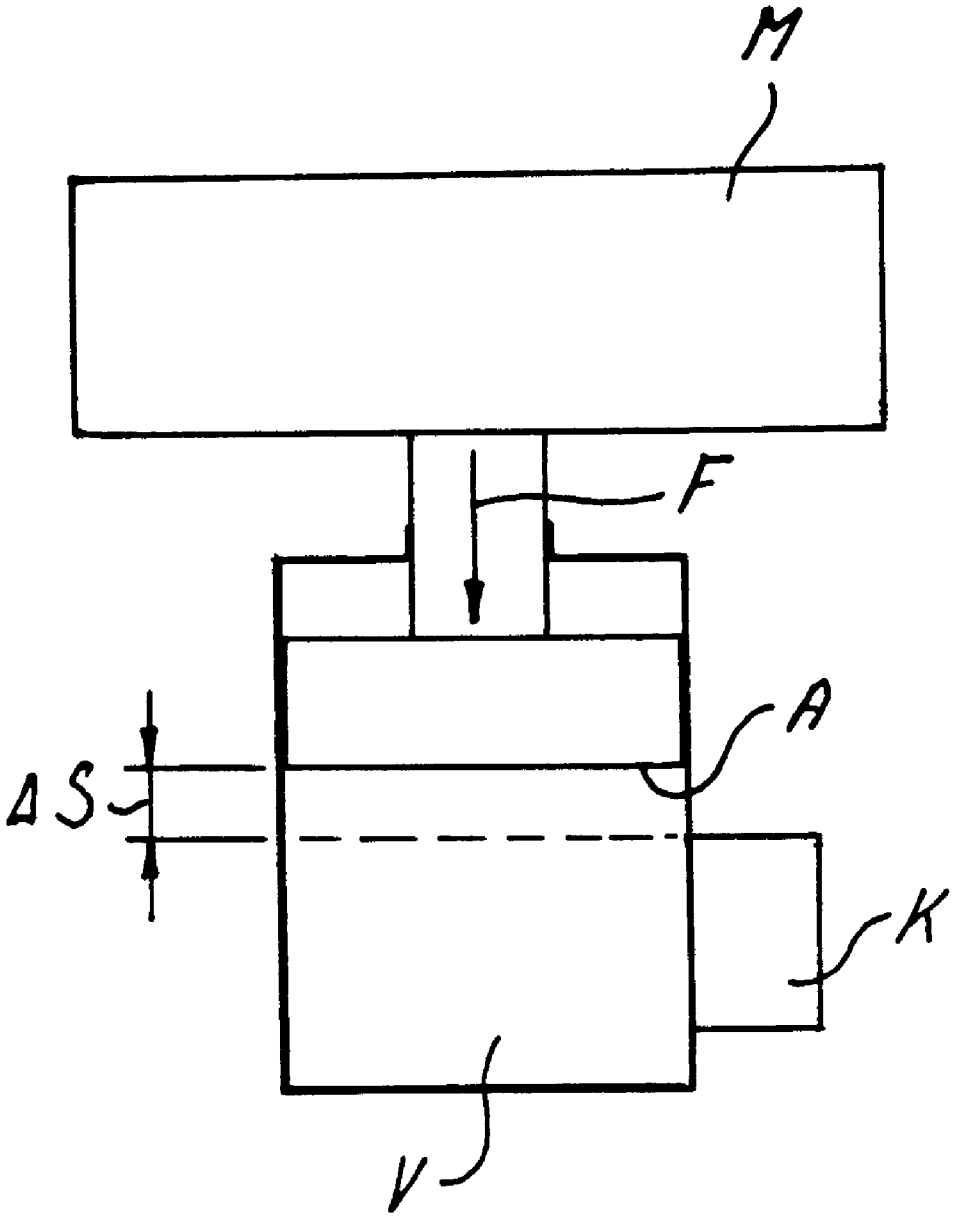
FIG. 3 shows a diagram with symbols.

With reference to FIG. 3, the following relationships can be established:

The rise in pressure in the cylinder is: $p1-p2=\Delta p$, and the resulting change in volume is: $V_1-V_2=\Delta V$. The bulk modulus $$K = V\left(\frac{\delta P}{\delta V}\right)$$

or $$\frac{\delta V}{V} = \frac{\delta P}{K}$$

or $$\frac{\Delta V}{V} = \frac{\Delta P}{K};\ \Delta V = A \cdot \Delta s:\ \Delta p = \frac{\Delta F}{A}$$

The "spring stiffness" of the oil enclosed between valve and piston is $$C = \frac{\Delta F}{\Delta S} = \frac{\Delta p A^2}{\Delta V}$$

and $$\Delta p = \frac{\Delta V K}{V}$$

and therefore $$C = \frac{\Delta V \cdot K A^2}{\Delta V \cdot V} = \frac{K \cdot A^2}{V}$$

The spring stiffness of the hydraulic spring is thus $$C = \frac{K \cdot A^2}{V}$$

The natural frequency of this system can be expressed as follows:

$$\omega_0^2 = (2\pi f_0)^2 = \frac{C}{M} - 2\pi f = \sqrt{\frac{C}{M}}$$

According to the invention a specific frequency range is now chosen at which the installation according to FIG. 1 is operated. In the graph in FIG. 2, the lower limit of this range is indicated by reference numeral 18 and the upper limit by 19. The amplitude obtained is shown on the vertical axis of the graph.

As the frequency passes through thie frequency range, a peak 21 in the amplitude $a_0$ obtained now occurs at frequency $f_0$, indicated by 20, which peak is determined by the mass and the spring stiffness of the mass spring system described above. An acceleration which is as high as possible will therefore occur at said frequency $f_0$. On reaching said frequency, the vibration device according to the invention has to be operated for a short time only, since the accelerations generated are so high that the mortar compacts within a short time.

After compaction, the product is removed from the mould on the transport plate.

What is claimed is:

1. Method for the operation of a compacting installation for compacting a granular, loosely coherent mass in order to obtain end products which installation comprises a vibrating table as well as a mold for the mass to be compacted, a stamp for pressing the mass into the mold, a hydraulic exciter and a hydraulic pressure element connected to the vibrating table and the stamp, respectively, and drive and control means for controlling exciter and pressure element, which method comprises the following steps:

selection of a frequency range with a lower value and an upper value for the excitation frequency, and control of the excitation frequency such that it passes through at least part of said frequency range and reaches the natural frequency of the hydraulic-mechanical single mass-single spring system having a single mass formed by a movable part of the exciter, the vibrating table, the mold and the mass to be compacted, and a single spring formed by a compressible hydraulic medium present between the movable part of the exciter and the drive means concerned.

2. Method according to claim 1, further comprising the step of changing the pressure in the hydraulic pressure element depending on the progress of the compaction process which occurs under the influence of the excitation frequency supplied by the exciter.

3. Method according to claim 1, wherein the pressure in the hydraulic pressure element is controlled in accordance with a pressure/time function and the frequency of the hydraulic exciter is controlled in accordance with a frequency/time function, which functions are linked.

4. Method according to claim 1, wherein the volume of the compressible hydraulic medium is varied.

5. An installation for compacting a granular, loosely coherent mass in order to obtain end products, the installation comprising:

a vibrating table; a mold for the mass to be compacted; a stamp for pressing the mass into the mold; a hydraulic exciter and a hydraulic pressure element connected to said vibrating table and said stamp, respectively; and control means for controlling the dynamic volume flow (frequency) in said exciter, the vibrating table and the mold being fixable to each other to vibrate as one when vibrated by the exciter;

wherein said control means is arranged and constructed to control an excitation frequency of said exciter to pass through at least part of an excitation frequency range that is between a lower value and an upper value and to reach a natural frequency of the hydraulic-mechanical single mass-single spring system having a single mass formed by a moveable part of said exciter, said vibrating table, said mold and the mass therein, and a single spring formed by a compressible hydraulic medium present in the exciter.

6. Installation according to claim 5, wherein the mold is open on its underside and the mold is placed on a transport plate which closes off the mold on said underside and is adapted to be fixed together with the mold on the vibrating table.

7. Installation according to claim 5, wherein the vibrating table comprises clamping jaws for clamping the mold on the vibrating table.

8. Installation according to claim 7, wherein the mold has clamping surfaces which face away from the vibrating table, on to which clamping surfaces the clamping jaws are able to engage.

9. Installation according to claim 7, wherein the clamping force exerted by the clamping jaws is adjustable.

10. Installation according to claim 5, wherein the hydraulic exciter is connected to means for varying the volume of a hydraulic medium to influence the stiffness of the hydraulic-mechanical single mass-single spring system.

* * * * *